US011798766B2

(12) United States Patent
Gäck et al.

(10) Patent No.: US 11,798,766 B2
(45) Date of Patent: Oct. 24, 2023

(54) SURGE PROTECTOR

(71) Applicant: DEHN SE, Neumarkt i.d.OPf. (DE)

(72) Inventors: Florian Gäck, Beilngries (DE); Julius Schrafl, Neumarkt (DE); Markus Götz, Deining (DE); Hans Herold, Berching (DE); Thomas Böhm, Hohenfels (DE); Benjamin Moosburger, Seubersdorf (DE); Thomas Sellerer, Freihausen (DE); Dominik Wölfl, Seubersdorf (DE); Michael Hess, Neumarkt (DE)

(73) Assignee: DEHN SE, Neumarkt i.d. OPf. (DE)

( * ) Notice: Subject to any disclaimer, the term of this patent is extended or adjusted under 35 U.S.C. 154(b) by 0 days.

(21) Appl. No.: 17/791,120

(22) PCT Filed: Feb. 26, 2021

(86) PCT No.: PCT/EP2021/054909
§ 371 (c)(1),
(2) Date: Jul. 6, 2022

(87) PCT Pub. No.: WO2021/170837
PCT Pub. Date: Sep. 2, 2021

(65) Prior Publication Data
US 2023/0036343 A1 Feb. 2, 2023

(30) Foreign Application Priority Data
Feb. 26, 2020 (DE) ..... 102020202428.6

(51) Int. Cl.
*H01H 71/02* (2006.01)
*H01H 71/10* (2006.01)
*H01T 4/06* (2006.01)

(52) U.S. Cl.
CPC ..... *H01H 71/10* (2013.01); *H01H 71/02* (2013.01); *H01T 4/06* (2013.01)

(58) Field of Classification Search
CPC ..... H01R 13/502; H01R 25/14; H01R 13/40; H01R 24/00; H01R 4/2429; H01R 9/2416;
(Continued)

(56) References Cited

U.S. PATENT DOCUMENTS 10,049,795 B2 8/2018 Hirschmann et al.
2013/0010395 A1* 1/2013 Birkholz ..... H01R 9/2641 361/91.1
(Continued)

FOREIGN PATENT DOCUMENTS

DE 4241331 C1 1/1994
DE 102006034164 A1 11/2007
(Continued)

OTHER PUBLICATIONS

The Notification Concerning Transmittal of International Preliminary Report on Patentability (Chapter I of the Patent Cooperation Treaty), in English, dated Sep. 9, 2022, which was issued by the International Bureau of WIPO in Applicant's corresponding international PCT application having Serial No. PCT/EP2021/054909, filed on Feb. 26, 2021.
(Continued)

*Primary Examiner* — Bryan R Perez
(74) *Attorney, Agent, or Firm* — Bodner & O'Rourke, LLP; Gerald T. Bodner; Christian P. Bodner

(57) ABSTRACT

The invention provides a surge protector, in particular for information technology and/or communications technology systems, which is equipped with: a housing (ST, BT; GT); a first input terminal (E1) for applying a first external voltage signal; a second input terminal (E2) for applying a second external voltage signal; a first output terminal (A1) for outputting the first external voltage signal; a second output
(Continued)

terminal (A2) for outputting the second external voltage signal; a surge protection circuit device (G1, R1, Z1; G1, G2, R1, R2, Z1; G1, G2, R1, R2, Z1, Z2), at least part of which is provided on a circuit board (P) located in the housing (ST, BT; G); a first current path (ST1) for conducting the first external voltage signal from the first input terminal (E1) to the first output terminal (A1) bypassing the surge protection circuit device (G1, R1, Z1; G1, G2, R1, R2, Z1; G1, G2, R1, R2, Z1, Z2); a second current path (ST2) for conducting the second external voltage signal from the second input terminal (E2) to the second output terminal (A2) bypassing the surge protection circuit device (G1, R1, Z1; G1, G2, R1, R2, Z1; G1, G2, R1, R2, Z1, Z2); a third current path (ST3) for conducting the first external voltage signal from the first input terminal (E1) to the first output terminal (A1) via the surge protection circuit device (G1, R1, Z1; G1, G2, R1, R2, Z1; G1, G2, R1, R2, Z1, Z2); a first switching contact device (F1) for opening and closing the first current path (ST1); a first electrical surge protection component (G1) which is connected between the first and third current paths (ST1, ST3); and a mechanical tripping device (AU; B, S, EF, SL) for opening the first switching contact device (F1) when in a non-tripped state and for closing the first switching contact device (F1) in order to interrupt the third current path (ST3) when in a tripped state at a tripping current in the surge protection circuit device (G1, R1, Z1; G1, G2, R1, R2, Z1; G1, G2, R1, R2, Z1, Z2) caused by exceeding a nominal parameter and/or by degradation of the components.

17 Claims, 10 Drawing Sheets

(58) Field of Classification Search
CPC .... H01R 9/2625; H01R 4/2404; H01H 83/10; H02H 9/042; H02H 9/06; H01T 4/06; H01T 1/12
See application file for complete search history.

(56) References Cited

U.S. PATENT DOCUMENTS

| | | | | |
|---|---|---|---|---|
| 2017/0201054 | A1 | 7/2017 | Wittmann et al. | |
| 2022/0278487 | A1* | 9/2022 | Schrafl | H01R 13/6273 |
| 2023/0093276 | A1* | 3/2023 | Znideric | H02H 9/005 361/91.1 |

FOREIGN PATENT DOCUMENTS

| | | | |
|---|---|---|---|
| DE | 102006034164 | B4 | 7/2008 |
| DE | 102010033179 | A1 | 2/2012 |
| DE | 102011115722 | A1 | 4/2013 |
| DE | 102013019390 | A1 | 4/2015 |
| WO | WO2007128628 | A1 | 11/2007 |
| WO | WO2015181044 | A1 | 12/2015 |

OTHER PUBLICATIONS

English translation of the International Preliminary Report on Patentability (Chapter I of the Patent Cooperation Treaty), dated Aug. 30, 2022, which was issued by the International Bureau of WIPO in Applicant's corresponding international PCT application having Serial No. PCT/EP2021/054909, filed on Feb. 26, 2021.

Written Opinion of the International Searching Authority, in English, dated Jun. 7, 2021, which was issued by the International Bureau of WIPO in Applicant's corresponding international PCT application having Serial No. PCT/EP2021/054909, filed on Feb. 26, 2021.

International Search Report, in English, dated Jun. 7, 2021, which was issued by the International Bureau of WIPO in Applicant's corresponding international PCT application having Serial No. PCT/EP2021/054909, filed on Feb. 26, 2021.

* cited by examiner

SURGE PROTECTOR

PRIOR ART

The present invention relates to a surge protection apparatus, in particular for information technology and/or communications technology systems.

Although not limited thereto, the present invention and the problems on which it is based are explained in more detail below with reference to surge protection apparatuses for information technology and/or communications technology systems installed in series.

DE 10 2006 034 164 B4 describes a multi-pole lightning current arrester and/or surge arrester in a terminal block design for protecting information technology devices and systems and including a base part and a plug-in part. A printed circuit board arrangement with a surge protection circuit device is arranged in the plug-in part and can be connected to the base part via contact tongues.

DE 42 41 331 A1 describes a monitoring and/or safety module, wherein a switching element is thermosensitively attached via a soldered connection and preloaded by spring force. If the spring force exceeds the holding force of the soldered joint when the soldered connection melts, the switching element opens and interrupts an electrical connection.

Known surge protection circuit devices have surge protection components in the form of gas discharge arresters with breakdown voltages of typically several 100 V on the input side and suppressor diodes, for example Zener diodes, with breakdown voltages of typically several 10 V on the output side. Furthermore, longitudinal decoupling elements in the form of resistors, for example varistors or the like, are usually provided.

The following overload behavior of the surge protection components is known. Resistors (longitudinal decoupling elements) become high-impedance in the event of overload and interrupt the signal flow. In the event of overload or aging, suppressor diodes typically show low-impedance behavior (up to a short circuit). Gas discharge arresters (especially for data technology applications) behave like suppressor diodes and go into short-circuit (or become low-impedance) in the event of overload.

To date, possible aging or overloading of the above-mentioned surge protection components has occasionally been observed and signaled via a display, or defective components have been disconnected. In the event of a defect in the surge protection, the useful signal circuit has until now either been short-circuited (by a suppressor diode or gas discharge arrester) or interrupted (high-impedance resistor), resulting in a signal interruption and thus failure of the entire signal transmission path (signal/data loss).

DISCLOSURE OF THE INVENTION

The present invention provides a surge protection apparatus, in particular for information technology and/or communications technology systems, as claimed in patent claim 1.

Preferred developments of the present invention are the subject matter of the respective dependent claims.

The idea of the present invention is to prevent failure of the signal transmission path when the surge protection apparatus is tripped. In order to achieve this, a mechanical tripping device is implemented, which separates the current path or paths leading through the surge protection circuit device and provides one or more current paths which carry the external voltage signal or signals from the respective input to the respective output, while bypassing the surge protection circuit device. The mechanical tripping device can be designed in such a way that it responds to both overload and aging phenomena.

According to a preferred development, the mechanical tripping device has a conductor track connection device which is attached to the printed circuit board using a soldered connection or conductive adhesive connection and which in a tripped state can be melted through the soldered connection or conductive adhesive connection if the predetermined tripping current is exceeded, wherein the conductor track connection device bypasses a first interruption point in the third current path in the non-tripped state, and a displaceable mechanical actuating device for opening the first switching contact device in the non-tripped state and for closing the first switching contact device in the tripped state and for removing the conductor track connection device in the tripped state. Such a conductor track connection device which is designed, for example, as a miniature circuit board enables one or more conductor tracks to be disconnected easily and reliably in order to decouple the surge protection component.

According to another preferred development, a second electrical surge protection component is connected in a fifth current path between the first output terminal and the second output terminal and the conductor track connection device bypasses a second interruption point in the fifth current path in the non-tripped state. In this way, several surge protection components can be decoupled at the same time.

According to another preferred development, the surge protection apparatus comprises a fourth current path for conducting the second external voltage signal from the second input terminal to the second output terminal via the surge protection circuit device; a second switching contact device for opening and closing the second current path; a third electrical surge protection component which is connected between the fourth current path and the first electrical surge protection component, wherein the conductor track connection device bypasses a second interruption point in the fourth current path in the non-tripped state, wherein a ground terminal is provided and a first node between the first surge protection component and the third surge protection component is connected to the ground terminal, and wherein the mechanical actuating device is set up for parallel opening of the first and second switching contact device in the non-tripped state and for parallel closing of the closing of the first and second switching contact device in the tripped state. In this way, the surge protection apparatus can be extended to two signal paths.

According to another preferred development, a fourth electrical surge protection component is connected between the second output terminal and the second electrical surge protection component, wherein a second node between the second and fourth surge protection components is connected to the ground terminal, wherein the conductor track connection device bypasses a fourth interruption point in the fifth current path between the fourth surge protection component and the second output terminal in the non-tripped state. In this way, all fault currents can be diverted to the ground terminal.

According to another preferred development, the mechanical actuating device has a rotatable pivoting part which is prestressed against the conductor track connection device by means of a spring device. Such a pivoting part can be easily attached to a printed circuit board.

According to another preferred development, the mechanical actuating device has a plunger which can be deflected by the pivoting part and which is connected to the first switching contact device or to the first and second switching contact devices via a link part. The first switching contact device or the first and second switching contact devices can thus be controlled in parallel or synchronously with a simple construction.

According to another preferred development, an impedance device, preferably a resistor, is provided in the third and/or fourth current path.

According to another preferred development, the first and/or third electrical surge protection component has a gas discharge tube.

According to another preferred development, the second and/or fourth electrical surge protection component has a bidirectional Zener diode, for example a TVS diode.

According to another preferred development, the first switching contact device or the first and second switching contact devices are designed as elastic spring tongues.

According to another preferred development, the housing is designed in one piece and has a trough-like lower part which can be closed by means of a cover plate.

According to another preferred development, the housing is designed in two parts and has a base part and a plug-in part, wherein the plug-in part is able to be plugged in in the base part in a latching and releasable manner, wherein the first and second current path, the first and second input terminal and the first and second output terminal and the first or the first and second switching contact device are provided in the base part and wherein the surge protection circuit device, the printed circuit board and the mechanical actuating device are provided in the plug-in part.

According to another preferred development, a plurality of plug-in contacts for electrically connecting the plug-in part to the base part are attached to the printed circuit board and protrude out of the plug-in part and can be inserted into the base part.

According to another preferred development, the mechanical actuating device is designed in such a way that, when the plug-in part is not plugged into the base part, the first or the first and second switching contact device are closed. This enables the faulty plug-in part to be replaced without the signal being interrupted and the system malfunctioning as a result.

According to another preferred development, the mechanical actuating device has a plunger which can be deflected by the pivoting part and which can be inserted into the base part to open the first switching contact device or the first and second switching contact devices in the non-tripped state.

According to another preferred development, the plug-in part and the base part each have a trough-like lower part which can be closed by means of a respective cover plate.

BRIEF DESCRIPTION OF THE DRAWINGS

For a better understanding of the present invention and the advantages thereof, reference is now made to the following description in connection with the accompanying drawings.

The invention is explained in more detail below using exemplary embodiments which are provided in the schematic illustrations of the drawings.

In the drawings:

Figure 1A:
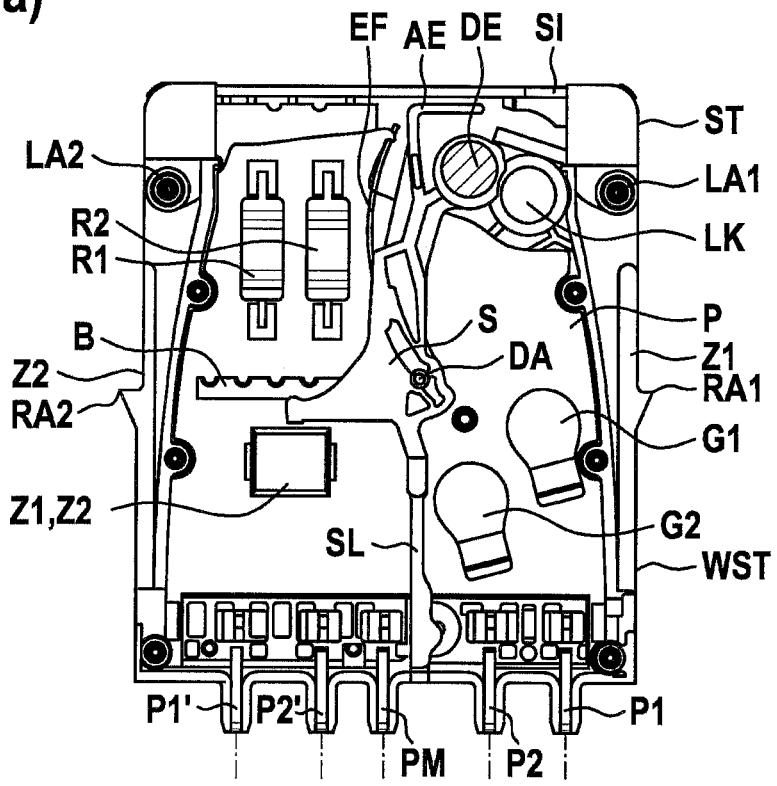
Figure 1B:
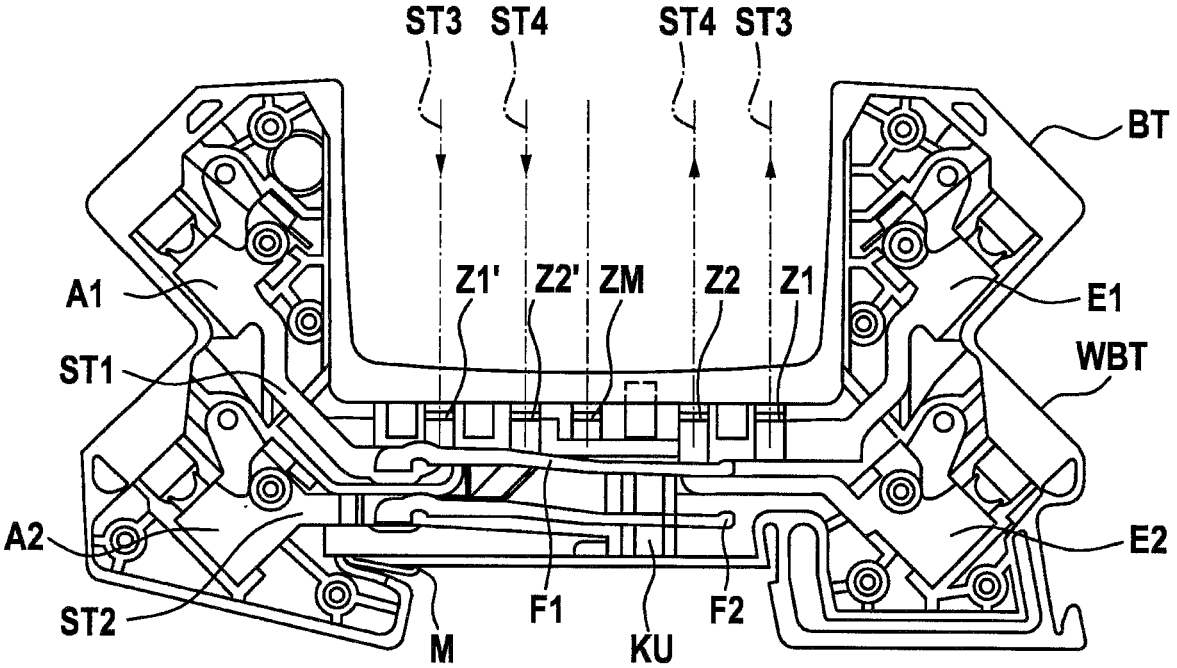
Figure 1C:
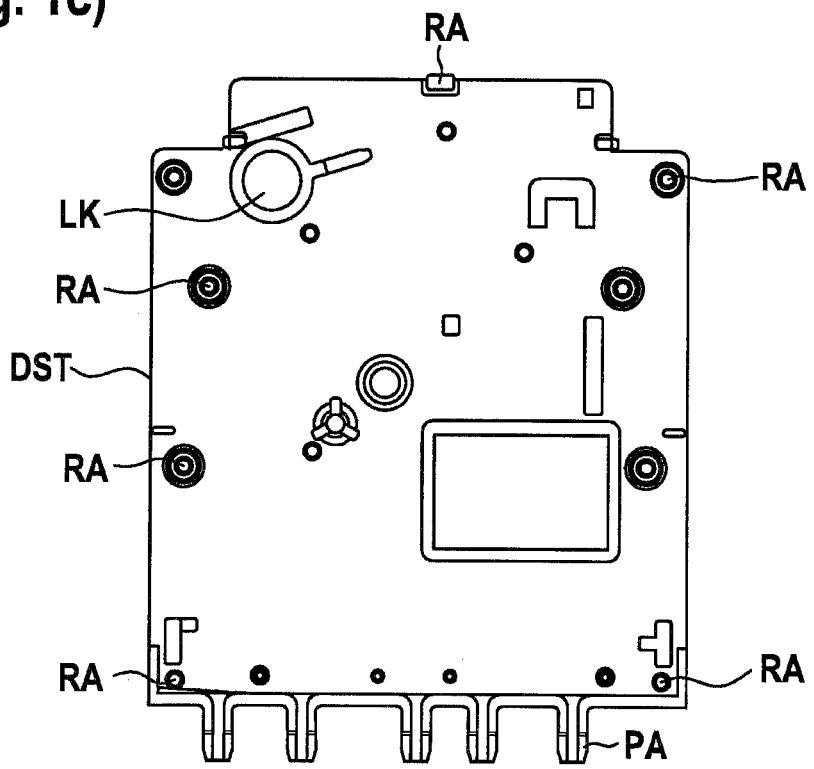
Figure 1D:
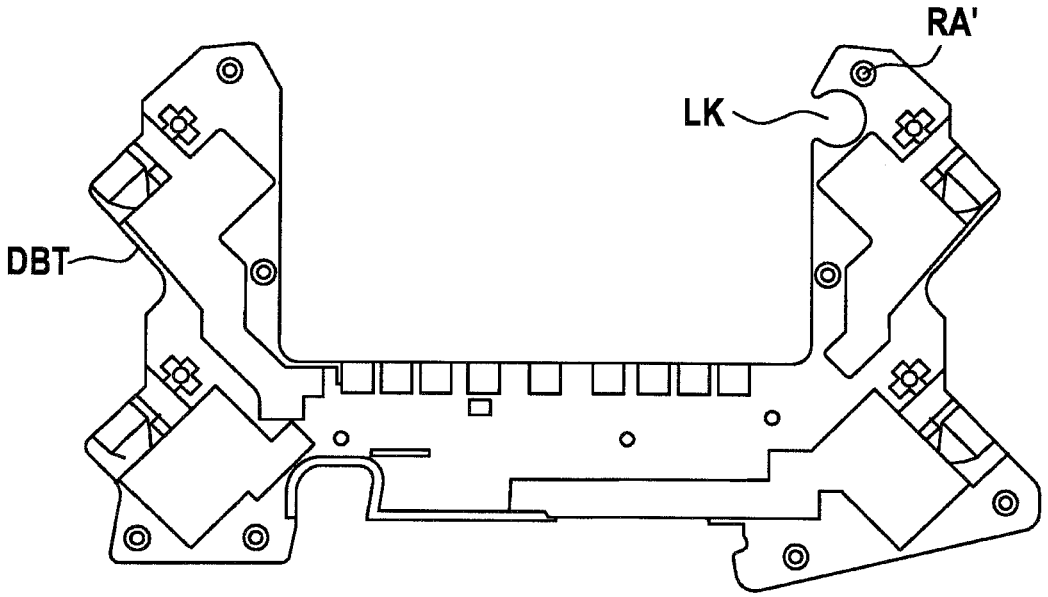
Figure 2A:
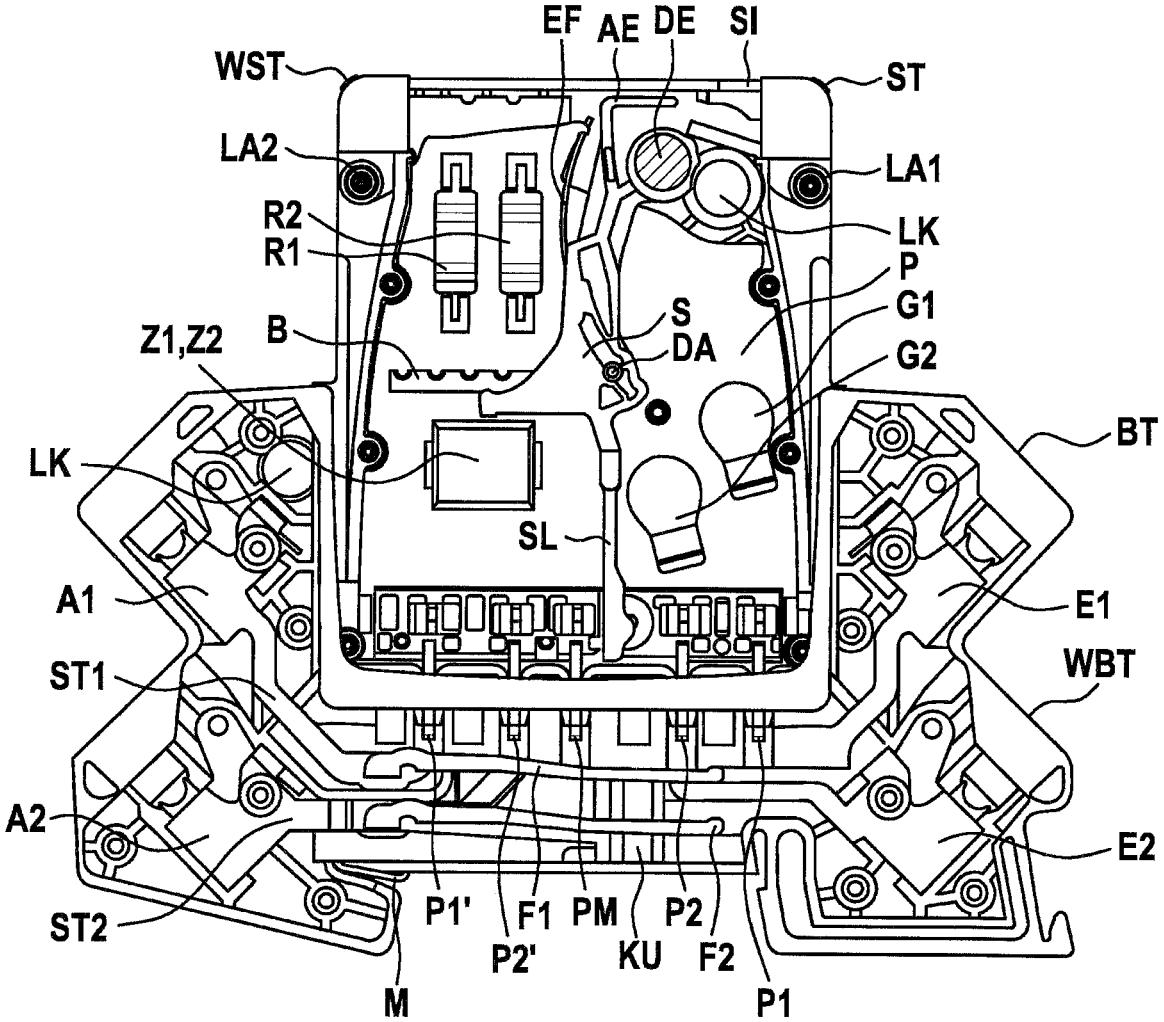
Figure 2B:
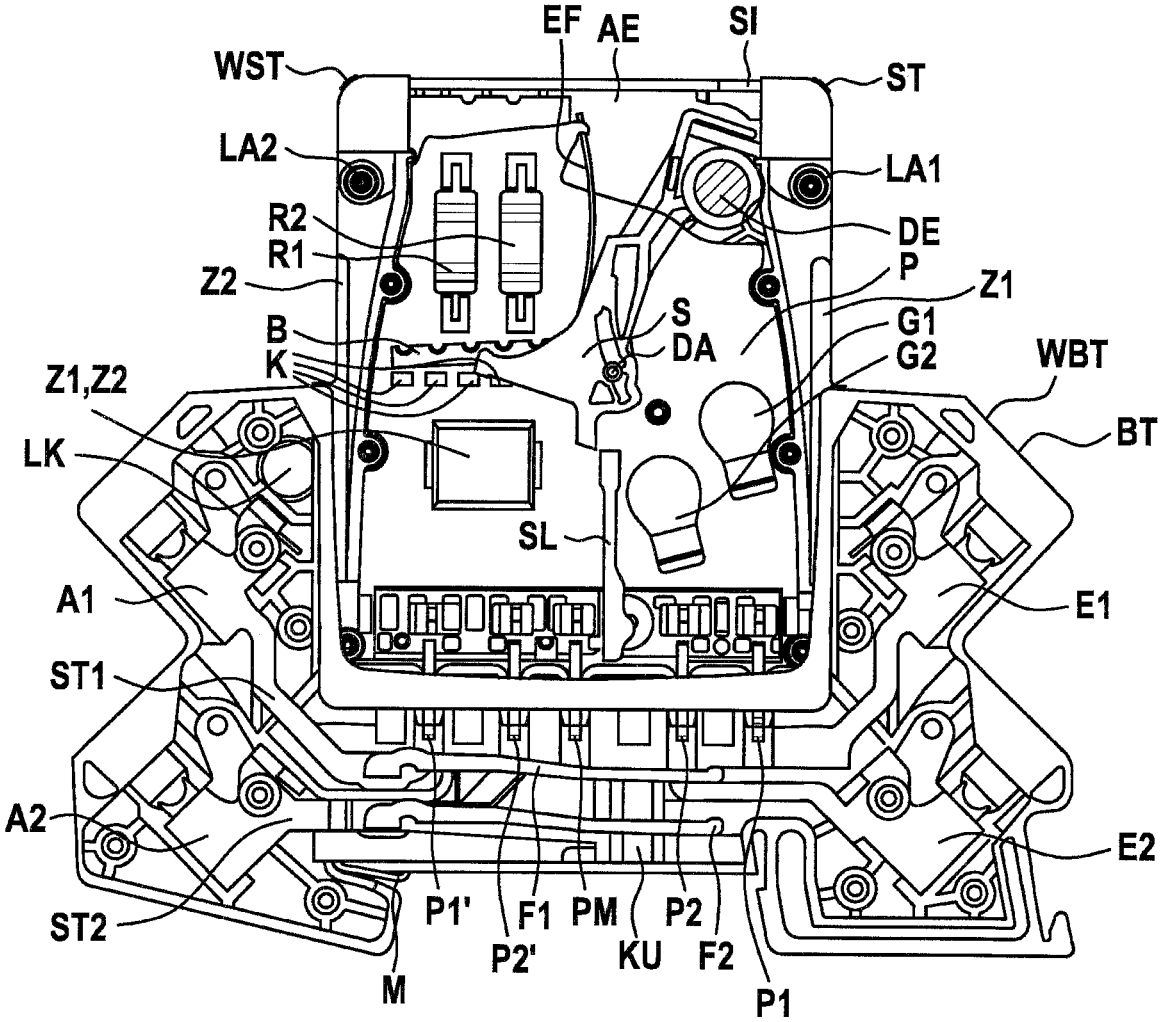
Figure 3A:
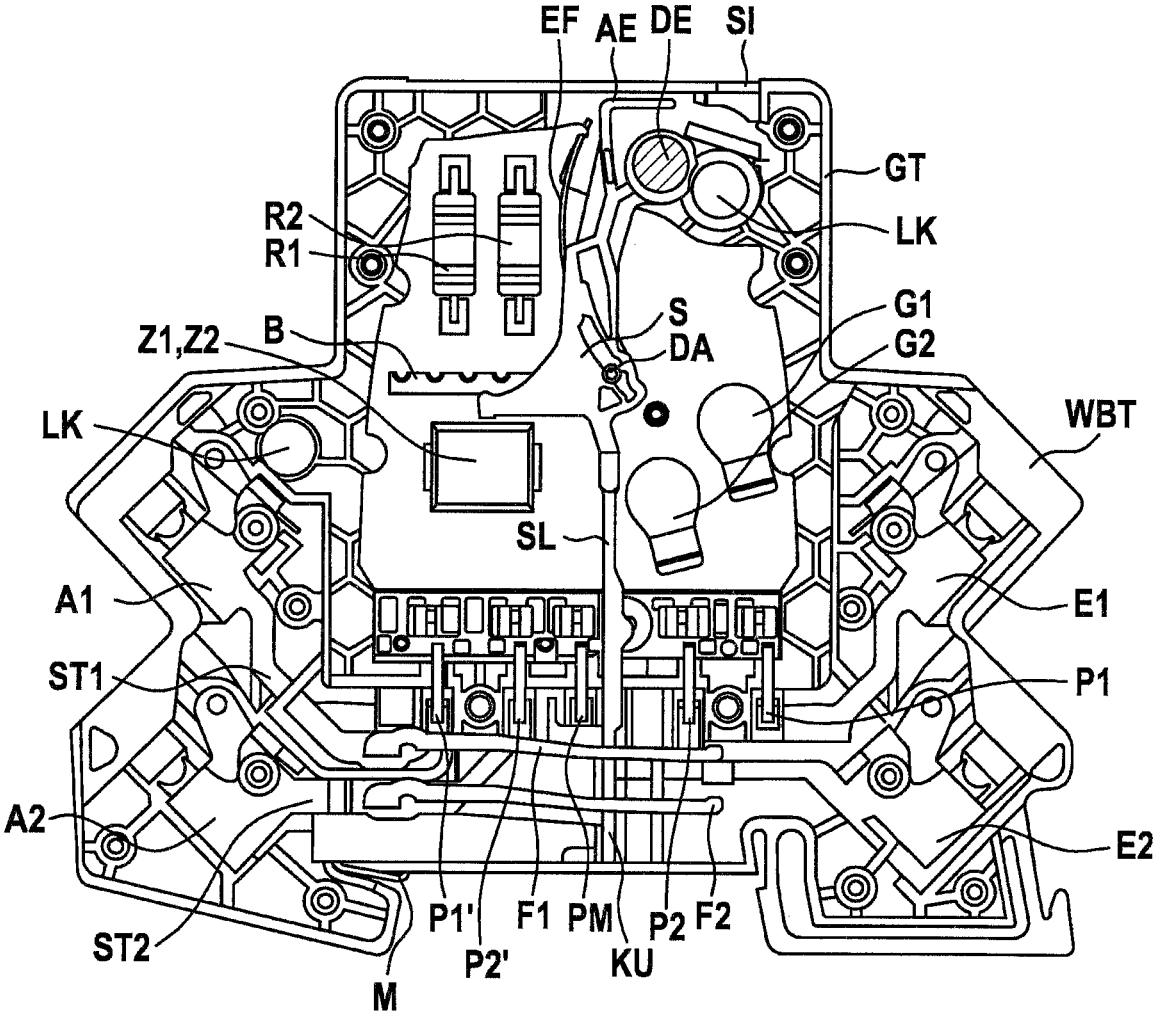
Figure 3B:
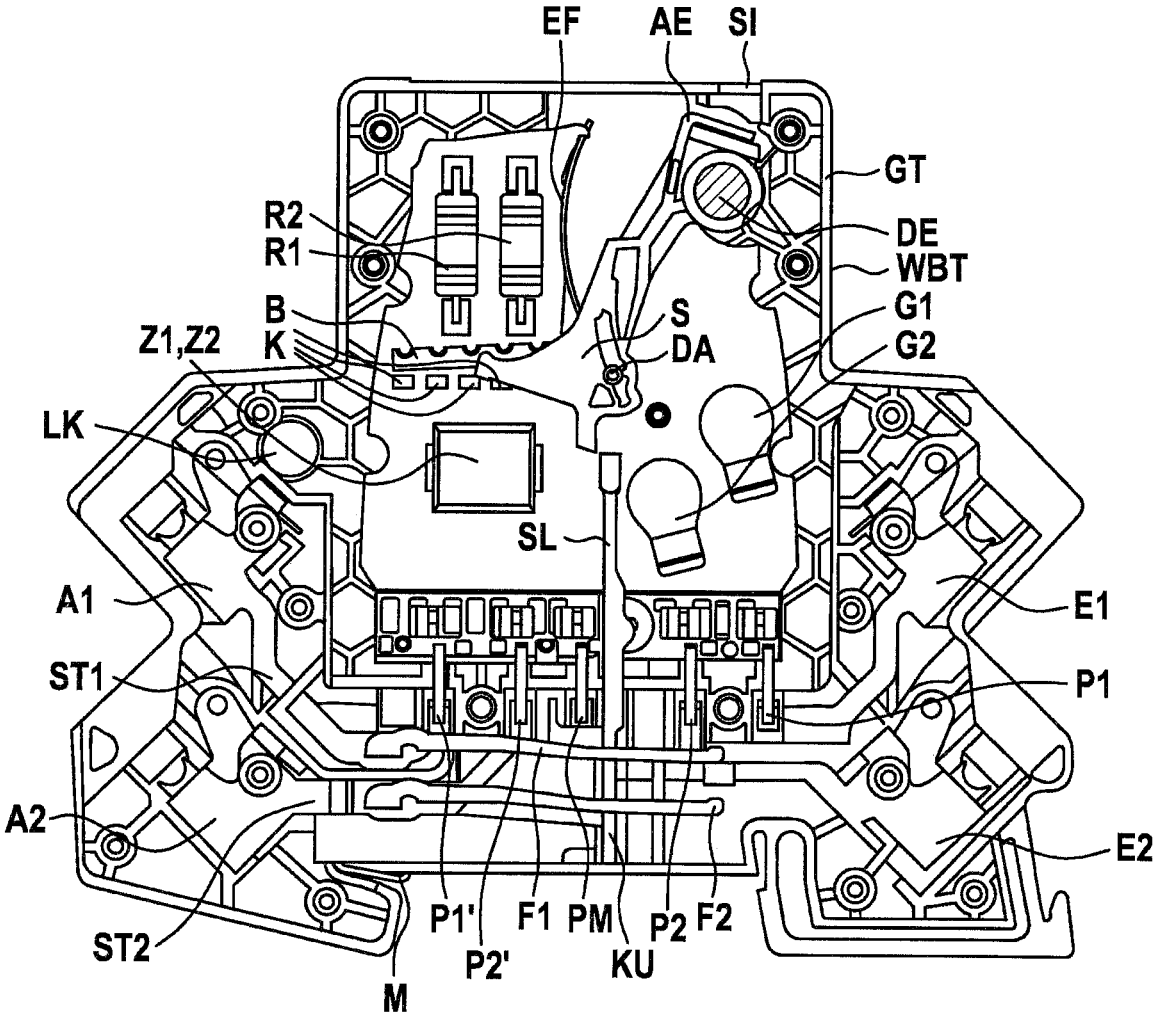
Figure 3C:
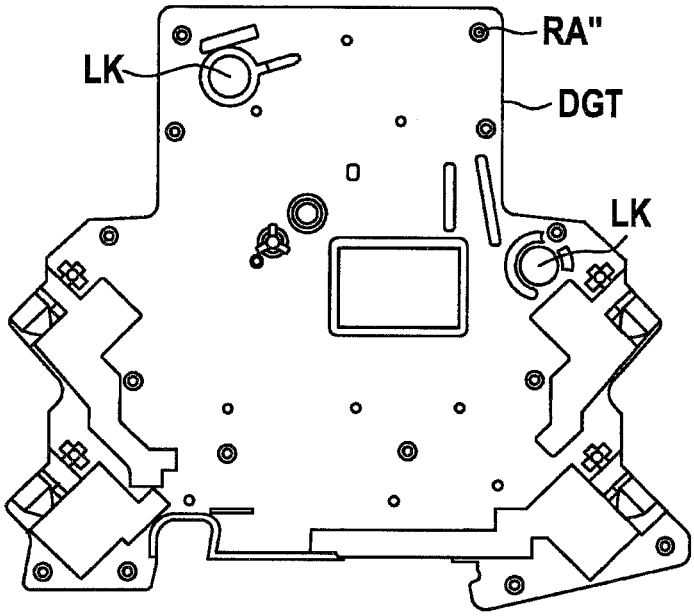
Figure 4:
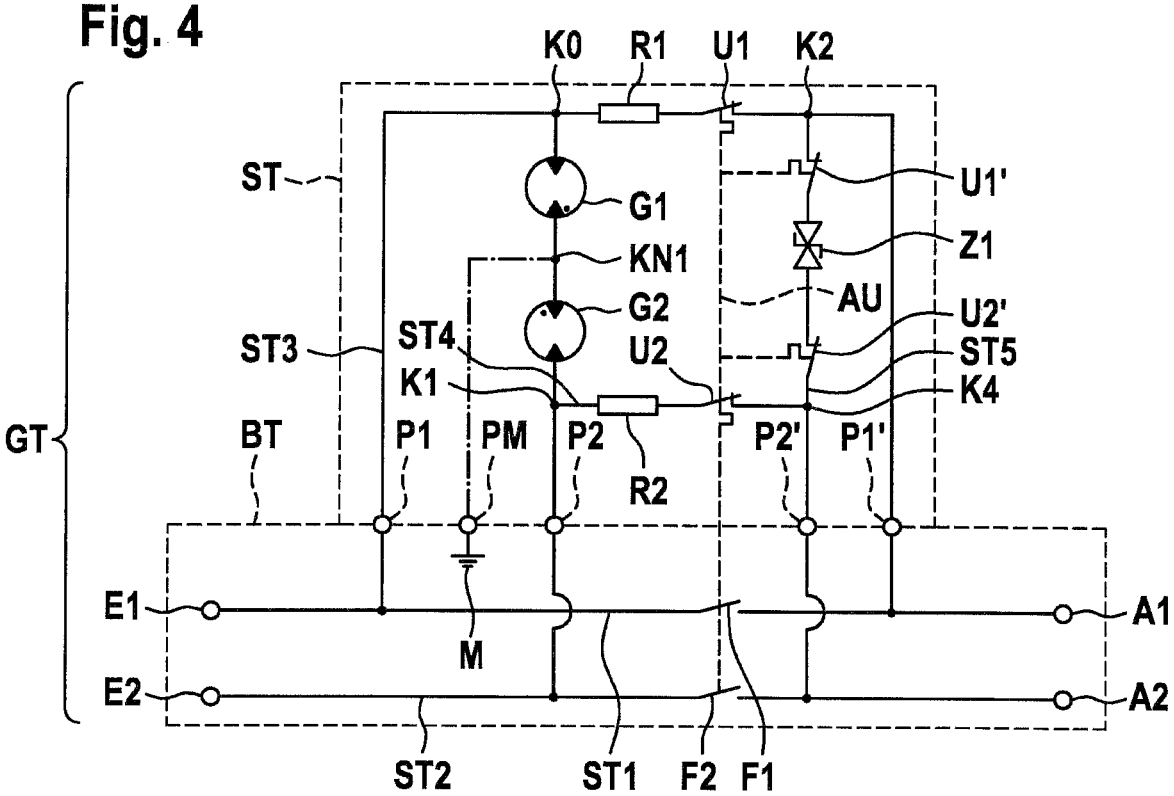
Figure 5:
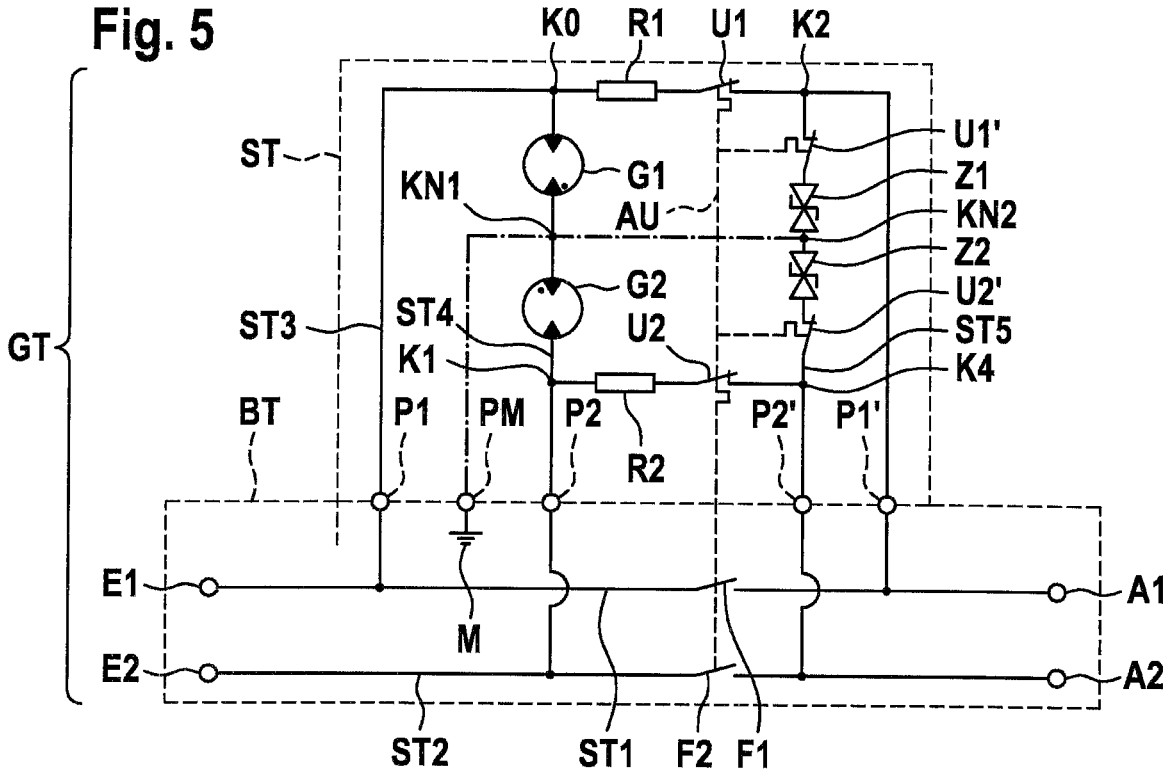
Figure 6:
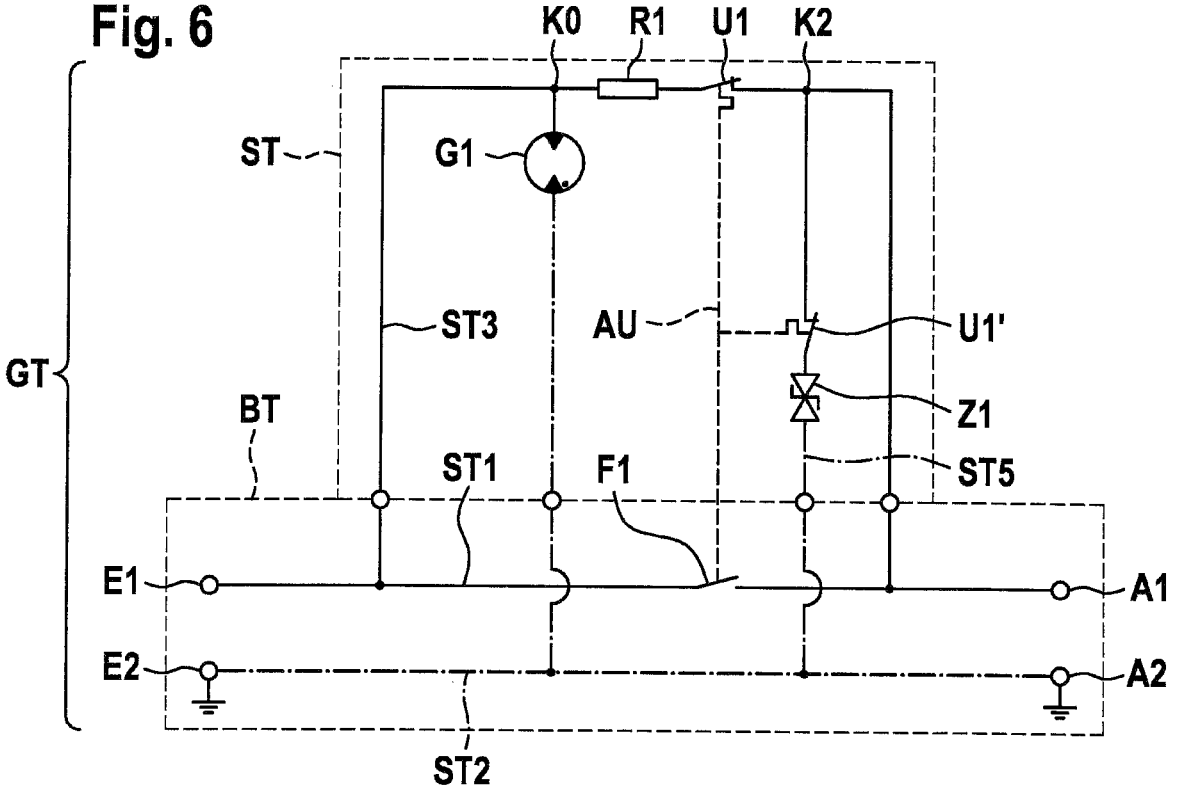
Figure 7A:
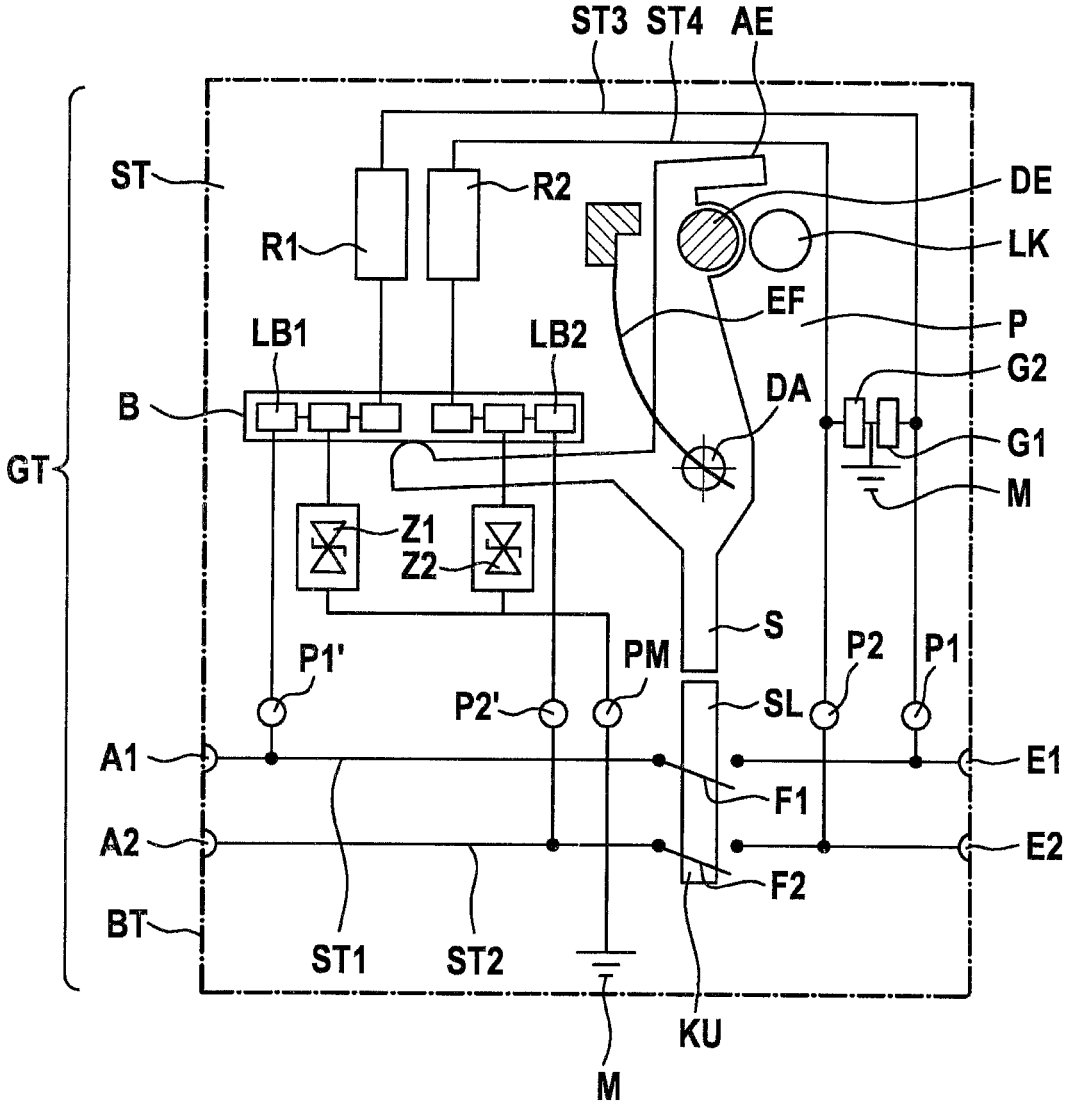
Figure 7B:
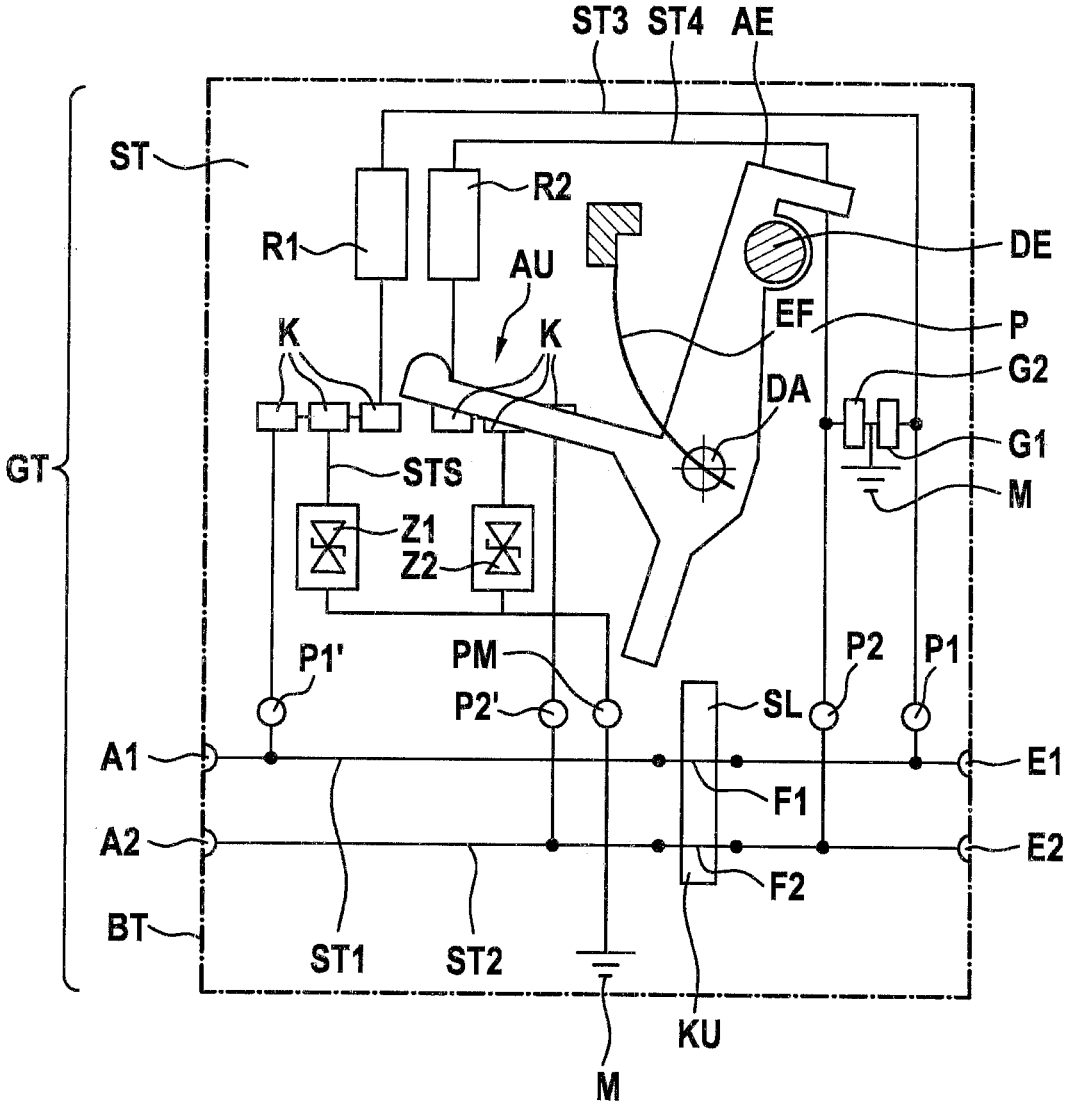

FIG. 1*a*)-*d*) show schematic housing interior plan views of a two-piece surge protection apparatus in the segmented state according to a first embodiment of the present invention, namely FIG. 1*a*) shows a plug-in lower part, FIG. 1*b*) a base part lower part, FIG. 1*c*) a plug-in part cover and FIG. 1*d*) a base part cover;

FIG. 2*a*), *b*) show schematic housing internal plan views of a two-piece surge protection apparatus in the assembled state according to the first embodiment of the present invention, namely FIG. 2*a*) in the non-tripped state and FIG. 2*b*) in the tripped state;

FIG. 3*a*)-*c*) show schematic housing internal plan views of a one-piece surge protection apparatus according to a second embodiment of the present invention, namely FIG. 3*a*) shows a lower part in the non-tripped state, FIG. 3*b*) shows a lower part in the tripped state and FIG. 3*c*) shows a cover;

FIG. 4 shows a circuit diagram for explaining a first exemplary electrical implementation of a surge protection circuit device in the surge protection apparatus according to the first or second embodiment;

FIG. 5 shows a circuit diagram for explaining a second exemplary electrical implementation of a surge protection circuit device in the surge protection apparatus according to the first or second embodiment;

FIG. 6 shows a circuit diagram for explaining a third exemplary electrical implementation of a surge protection circuit device in the surge protection apparatus according to the first or second embodiment; and FIG. 7*a*), *b*) show functional diagrams for explaining an exemplary mechanical-electrical implementation of an exemplary mechanical tripping device in the surge protection apparatus according to the first or second embodiment, specifically FIG. 7*a*) in the non-tripped state and FIG. 7*b*) in the tripped state.

Unless otherwise indicated, the same reference numbers refer to identical elements of the drawings.

FIG. 1*a*)-*d*) show schematic housing interior plan views of a two-piece surge protection apparatus in the segmented state according to a first embodiment of the present invention, namely FIG. 1*a*) shows a plug-in lower part, FIG. 1*b*) a base part lower part, FIG. 1*c*) a plug-in part cover and FIG. 1*d*) a base part cover.

As illustrated in FIG. 1*a*), the surge protection apparatus according to the first embodiment has a plug-in part ST which has a trough-like lower part WST. In the interior of the trough-shaped lower part WST of the plug-in part ST there is provided a printed circuit board P on which a surge protection circuit device is formed.

The surge protection circuit device has a first impedance R1, for example a first linear resistor, and a second impedance R2, for example a second linear resistor R2. Furthermore, the surge protection circuit device has a first gas discharge tube G1 and a second gas discharge tube G2 as well as a first bidirectional Zener diode Z1 and a second bidirectional Zener diode Z2.

Using a soldered connection or conductive adhesive connection, a conductor track connection device B is attached to the printed circuit board P, the conductor track connection device in a tripped state being able to be removed given a tripping current (leakage current) caused by exceedance of a nominal parameter (overload) and/or by degradation of the components, at which tripping current the soldered connection or conductive adhesive connection is able to be melted, such that corresponding conductor tracks are interrupted. In particular, the conductor track connection device B connects some interruption points in the surge protection circuit device, as will be explained in more detail later.

Also provided on the printed circuit board P is a displaceable mechanical actuating device which has a rotatable pivoting part S which is prestressed against the conductor track connection device B by means of a spring device EF. Reference sign DA in this case designates the axis of rotation of the pivoting part S. Furthermore, the rotatable pivoting part S is in mechanical contact with a plunger SL which protrudes from the trough-like lower part WST in the non-tripped state and can be pushed into the trough-like lower part WST in the tripped state.

A light channel LK, which, when the pivoting part S is pivoted, can be closed in the tripped state by a cover device DE which is connected to the pivoting part S in one piece, is provided in the lower wall of the trough-like lower part WGT. Additionally integrally connected to the pivoting part S is a display device AE which can be pivoted in front of a viewing window SI of the trough-like lower part WGT when the pivoting part S is pivoted in the tripped state in order to display a tripped state, for example by way of a corresponding color marking, for example red.

In addition, the surge protection apparatus according to the first embodiment has a base part BT which also has a trough-like lower part WBT, as will be explained in more detail below with reference to FIG. 1*b*).

On the side of the plug-in part ST facing the base part BT, there are a plurality of plug-in contacts P1, P2, P1', P2', PM on the printed circuit board P for electrically connecting the plug-in part ST to the base part BT.

When the plug-in part ST is plugged into the base part BT, latching lugs RA1, RA2, which are provided on resiliently elastic tongues Z1, Z2, are used for releasably locking the plug-in part ST to the base part BT. The latching can be released, for example, with rotatable tabs LA1, LA2 in the trough-like lower part WST.

Furthermore with reference to FIG. 1*b*), in the trough-like lower part WBT of the base part BT, there is housed a first input terminal E1 for applying a first external voltage signal, a second input terminal E2 for applying a second external voltage signal, a first output terminal A1 for outputting the first external voltage signal and a second output terminal A2 for outputting the second external voltage signal.

A first current path ST1 is formed in the base part BT and is used to conduct the first external voltage signal from the first input terminal E1 to the first output terminal A1 while bypassing the surge protection circuit device.

A second current path ST2 is formed in the base part BT and is used to conduct the second external voltage signal from the second input terminal E2 to the second output terminal A2 while bypassing the surge protection circuit device.

A first switching contact device F1 is used to open and close the first current path ST1 and a second switching contact device F2 is used to open and close the second current path ST2. In the present example, the first switching contact device F1 and the second switching contact device F2 are designed as elastic spring tongues which can be deflected via the plunger SL of the mechanical actuating device in the plug-in part ST to open and close the first or second current path ST1, ST2, as will be explained in more detail later. The first and second switching contact device F1, F2 are coupled via a link part KU so that they can be switched in parallel or simultaneously by the plunger SL.

Also formed in the base part BT is a branch contact Z1 to a third current path ST3, which leads via the plug-in contacts P1 and P1' to a further branch contact Z1', for conducting the first external voltage signal from the first input terminal E1 to the first output terminal A1 via the surge protection circuit device with the plug-in part ST inserted in the non-tripped state.

Also formed in the base part BT is a branch contact Z2 to a fourth current path ST4, which leads via the plug-in contacts P2 and P2' to a further branch contact Z2', for conducting the second external voltage signal from the second input terminal E2 to the second output terminal A2 via the surge protection circuit device with the plug-in part ST inserted in the non-tripped state.

When the plug-in part ST is plugged in, a plug-in contact PM is connected to a branch contact ZM which in turn is connected to a ground terminal M in the plug-in part ST which is provided on the underside of the trough-like lower part WBT of the base part BT.

In the present embodiment, the underside of the trough-like lower part WBT is designed, for example, in such a way that it can be mounted on a mounting rail that can be grounded.

Plug-in holes corresponding to the plug-in contacts P1, P2, PM, P1', P2' are arranged in the base part BT. It should also be mentioned here that the arrangement of the plug-in contacts P1, P2, P1', P2', PM is deliberately chosen asymmetrically in order to enable assembly in a position rotated by 180° in such a way that the first switching contact device F1 and the second switching contact device F2 are permanently open regardless of state.

Furthermore with reference to FIG. 1*c*), the cover plate DST of the plug-in part ST is shown, which has a corresponding opening for the light channel LK and which has latching elements RA for latching with the trough-like lower part WST, as well as corresponding coverings PA for the plug-in contacts P1, P2, P1', P2', PM.

The cover plate DBT for the base part BT is shown analogously in FIG. 1*d*), said base part also having latching elements RA' for latching the cover plate DBT to the trough-like lower part WBT and the light channel LK.

FIG. 2*a*), b) show schematic housing internal plan views of a two-piece surge protection apparatus in the assembled state according to the first embodiment of the present invention, namely FIG. 2*a*) in the non-tripped state and FIG. 2*b*) in the tripped state.

In the state shown in FIG. 2*a*), the plug-in part ST is latched in the base part BT. The plunger SL of the mechanical actuating device presses on the link part KU and thus the first switching contact device F1 and the second switching contact device F2 are open, with the result that the first current path ST1 and the second current path ST2 are open and the first external voltage signal is routed via the surge protection circuit device from the first input terminal E1 to the first output terminal A1. Likewise, the second external voltage signal is routed from the second input terminal E2 via the fourth current path ST4 via the surge protection circuit device to the second output terminal A2. As can also be seen from FIG. 2*a*), the pivoting part S is prestressed against the soldered conductor track connection device B and is in the non-tripped state.

FIG. 2*b*) illustrates the tripped state in which the soldered connection or conductive adhesive connection of the conductor track connection device B has melted after the predetermined tripping current has been exceeded and the conductor track connection device B is thus removed from the contact points K so that the interruption points, as explained in more detail below, are no longer bypassed by the conductor track connection device B.

At the same time, the plunger SL of the mechanical actuating device is deflected upward after the pivoting part S has been pivoted so that the first switching contact device F1 and the second switching contact device F2 are closed in order to close the first current path ST1 and the second current path ST2 due to the elastic spring force.

The third current path ST3 and the fourth current path ST4 are open as a result of the removal of the conductor track connection device B so that the entire current flow through the first and second current path ST1, ST2 leads via the base part BT.

FIG. 3*a*)-*c*) show schematic housing internal plan views of a one-piece surge protection apparatus according to a second embodiment of the present invention, namely FIG. 3*a*) shows a lower part in the non-tripped state, FIG. 3*b*) shows a lower part in the tripped state and FIG. 3*c*) shows a cover.

The illustration according to FIG. 3*a*) corresponds to the illustration according to FIG. 2*a*) with only the housing GT being designed in one piece with a trough-like lower part WGT. The electrical and mechanical components correspond to those which have already been described with reference to FIG. 2*a*), b).

Analogously, in FIG. 3*b*) for a one-piece housing GT with a trough-like lower part WGT, the tripped state is shown analogously to FIG. 2*b*) in which the pivoting part S is pivoted and the conductor track connection device B is removed and the plunger SL is pushed upward so that all of the current flow passes via the first and second current path ST1, ST2.

With reference to FIG. 3*c*), the cover plate DGT for the trough-shaped lower part WGT is shown, which in turn has latches RA" and the light channel LK.

FIG. 4 shows a circuit diagram for explaining a first exemplary electrical implementation of a surge protection circuit device in the surge protection apparatus according to the first or second embodiment.

As illustrated in FIG. 4, the first current path ST1 runs from the first input terminal E1 via the first switching contact device F1 to the first output terminal A1. Analogously, the second current path ST2 runs from the second input terminal via the second switching contact device F2 to the second output terminal. In the illustration according to FIG. 4, the first and second switching contact device F1, F2 are open so that the first external voltage signal runs via the third current path from the first input terminal E1 to the first output terminal A1 and the second external voltage signal runs from the second input terminal E2 via the fourth current path ST4 to the second output terminal A2.

A first impedance R1, for example a first linear resistor, is connected into the third current path ST3. A second impedance R2, for example a second linear resistor R2, is connected into the fourth current path ST4.

A series circuit of a surge protection component in the form of a first gas discharge tube G1 and a surge protection component in the form of a second gas discharge tube G2 is connected between a node K0 in the third current path ST3 before the first resistor R1 and a node K1 in the fourth current path ST4 before the second resistor R2, with a node KN1 located between the first and second gas discharge tubes G1, G2 being connected to the ground terminal M.

The first and second gas discharge tubes G1, G2 typically have a breakdown voltage in the range of from 70 volts to 600 volts and can therefore divert surges occurring at the first or second input terminal E1, E2 to the ground terminal M.

A further surge protection component in the form of a bidirectional Zener diode Z1 is connected between a node K2 in the third current path ST3 behind the first resistor R1 and a node K4 in the fourth current path ST4 behind the second resistor R2. A fifth current path ST5 runs through the bidirectional Zener diode Z1.

The mechanical tripping device AU, which as described above comprises the conductor track connection device B, the pivoting part S, the elastic spring device EF and the plunger SL, bypasses a first interruption point U1 in the third current path, a second interruption point U2 in the fourth current path, a third interruption point U1' in the fifth current path, which lies between the third current path ST3 and the bidirectional Zener diode Z1, and a fourth interruption point U2', which lies between the bidirectional Zener diode Z1 and the fourth current path ST4 when the non-tripped state is present. The mechanical tripping device AU also opens the first switching contact device F1 and the second switching contact device F2 via the plunger SL in the non-tripped state.

If, as described above, a predetermined tripping current flows through the soldered connection or conductive adhesive connection of the conductor track connection device B, the soldered connection or conductive adhesive connection at the respective contacts K, which will be explained in more detail later by way of example, is opened, and the conductor track connection device B is removed by the elastic, pre-stressed pivot part S.

The consequence of this is that the first interruption point U1, the second interruption point U2, the third interruption point U1' and the fourth interruption point U2' are no longer bypassed, that is to say interrupted, and that the plunger SL no longer opens the first switching contact device F1 and the second switching contact device F2 but releases them and the elastic spring force closes them so that the first and second external voltage signal are routed directly from the first input terminal E1 via the first current path ST1 to the first output terminal and the second external voltage signal is routed directly via the current path ST2 from the second input terminal to the second output terminal, as a result of which the surge protection circuit device is bypassed by the first and second external voltage signals.

In the case of the surge protection apparatus having the two-piece housing which consists of the plug-in part ST and the base part BT, the plug-in part ST can thus be exchanged with the surge protection circuit device and the mechanical tripping device AU without the signal flow through the first and second current path ST1, ST2 being interrupted.

FIG. 5 shows a circuit diagram for explaining a second exemplary electrical implementation of a surge protection circuit device in the surge protection apparatus according to the first or second embodiment.

According to FIG. 5, the second exemplary electrical implementation of the surge protection circuit device differs from the first implementation in that, instead of a single bidirectional Zener diode between the third interruption point U1' and the fourth interruption point U2', a series connection between a first bidirectional Zener diode Z1 and a second bidirectional Zener diode Z2 is provided, with a node KN2 between the first and second bidirectional Zener diode Z1, Z2 also being connected to the ground terminal M. Surges which occur at the first and second bidirectional Zener diodes Z1, Z2, which typically have a breakdown voltage of from 5 to 500 volts, can thus also be diverted to the ground terminal M in this second implementation.

The functioning of the mechanical tripping device AU is identical to that of the first implementation.

FIG. 6 shows a circuit diagram for explaining a third exemplary electrical implementation of a surge protection circuit device in the surge protection apparatus according to the first or second embodiment.

As illustrated in FIG. 6, in the third exemplary electrical implementation of the surge protection circuit device, only a first external voltage signal is applied to the first input terminal E1 and routed via the first switching contact device F1 to the first output terminal. In this implementation, the second input terminal E2 is at ground potential and is directly connected to the second output terminal A2.

As already described above, the third current path ST3 runs via the node K0, the first non-linear resistor R1, the first interruption point U1 and the second node K2 to the first output terminal. The first gas discharge tube G1 is connected between the node K0 and the first current path ST1 and the bidirectional Zener diode Z1 is connected between the node K2 and the second current path ST2, with this implementation involving only a first interruption point U1 between the first non-linear resistor R1 and the node K2 and a second interruption point U1' between the node K2 and the bidirectional Zener diode Z1.

The mechanical tripping device AU operates in this implementation only to the first interruption point U1 and the second interruption point U1' and the first switching contact device F1, with the functionality being analogous to the functionality described above in the first and second implementation.

FIG. 7*a*), *b*) show functional diagrams for explaining an exemplary mechanical-electrical implementation of an exemplary mechanical-electrical implementation of a mechanical tripping device in the surge protection apparatus according to the first or second embodiment, specifically FIG. 7*a*) in the non-tripped state and FIG. 7*b*) in the tripped state.

As shown in FIGS. 7*a*) and 7*b*), the conductor track connection device B in the form of a printed circuit board soldered on with respective conductor track sections LB1 and LB2 respectively bypasses three contacts K which are in the third current path ST3 and fourth current path ST4.

In the implementation according to FIG. 7, as in the implementation according to FIG. 5, two bidirectional Zener diodes Z1, Z2 are provided.

As illustrated in FIG. 7*b*), the conductor track connection device B is removed in the tripped state and is located, for example, loosely in the plug-in part ST or overall part GT, and the corresponding interruption points are open. Due to the low mass of the conductor track connection device B and due to a heat distribution surface attached to the underside of the printed circuit board P and due to a heat distribution surface attached to the top side of the printed circuit board P, heat generated "on one side" (at a contact K) is quickly distributed to all other soldering joints. This achieves simultaneous and even heating. Separation occurs when all solder joints have exceeded the eutectic temperature point.

The first and second switching contact device F1, F2 are also closed in the tripped state so that the first and second external voltage signal flow directly from the first input terminal E1 to the first output terminal A1 and from the second input terminal E2 to the second output terminal A2.

Although the present invention has been explained on the basis of preferred embodiments, it is not limited to these but can be modified in many ways. For example, the surge protection apparatus can be arranged on a mounting rail (top-hat rail) and also fastened to a printed circuit board via a special socket to protect terminal devices.

The housing geometry, in particular the arrangement of the input and output terminals, can be varied as required depending on the application. The mechanical tripping device is also not limited to the pivoting part and the conductor track connection device, but can be implemented in other ways using mechanical and electrical components.

Although exemplary surge apparatuses for the transmission of one or two external voltage signals have been explained in the above-described embodiments, the present invention is not limited thereto, but can be used generally for surge apparatuses with any number of external voltage signals.

The invention claimed is:

1. A surge protection apparatus, in particular for information technology and/or communication technology systems, having:

a housing (ST, BT; GT);

a first input terminal (E1) for applying a first external voltage signal, a second input terminal (E2) for applying a second external voltage signal, a first output terminal (Al) for outputting the first external voltage signal, a second output terminal (A2) for outputting the second external voltage signal;

a surge protection circuit device (G1, R1, Z1; G1, G2, R1, R2, Z1; G1, G2, R1, R2, Z1, Z2) which is at least partially provided on a printed circuit board (P) in the housing (ST, BT; G);

a first current path (ST1) for conducting the first external voltage signal from the first input terminal (E) to the first output terminal (A1) while bypassing the surge protection circuit device (G1, R1, Z1; G1, G2, R1, R2, Z1; G1, G2, R1, R2, Z1, Z2);

a second current path (ST2) for conducting the second external voltage signal from the second input terminal (E2) to the second output terminal (A2) while bypassing the surge protection circuit device (G1, R1, Z1; Gl, G2, R1, R2, Z1; G1, G2, R1, R2, Z1, Z2);

a third current path (ST3) for conducting the first external voltage signal from the first input terminal (E1) to the first output terminal (Al) via the surge protection circuit device (G1, R1, Z1; G1, G2, R1, R2, Z1; G1, G2, R1, R2, Z1, Z2);

a first switching contact device (F1) for opening and closing the first current path (ST1);

a first electrical surge protection component (G1) which is connected between the first and the third current path (ST1, ST3); and a mechanical tripping device (AU; B, S, EF, SL) for opening the first switching contact device (F1) in a non-tripped state and for closing the first switching contact device (F1) to interrupt the third current path (ST3) in a tripped state given a tripping current in the surge protection circuit device (G1, R1, Z1; G1, G2, R1, R2, Z1; G1, G2, R1, R2, Z1, Z2) caused by exceedance of a nominal parameter and/or by degradation of the components.

2. The surge protection apparatus as claimed in claim 1, wherein the mechanical tripping device (AU; B, S, EF, SL) comprises:

a conductor track connection device (B) which is attached to the printed circuit board (P) using a soldered connection or conductive adhesive connection and which in a tripped state can be melted through the soldered connection or conductive adhesive connection if the predetermined tripping current is exceeded;

wherein the conductor track connection device (B) bypasses a first interruption point (U1) in the third current path (ST3) in the non-tripped state; and a displaceable mechanical actuating device (S, EF, SL) for opening the first switching contact device (F1) in the non-tripped state and for closing the first switching contact device (F1) in the tripped state and for removing the conductor track connection device (B) in the tripped state.

3. The surge protection apparatus as claimed in claim 2, wherein a second electrical surge protection component (Z1) is connected in a fifth current path (ST5) between the first output terminal (A1) and the second output terminal (A2) and the conductor track connection device (B) bypasses a second interruption point (U1') in the fifth current path (ST5) in the non-tripped state.

4. The surge protection apparatus as claimed in claim 2, comprising a fourth current path (ST4) for conducting the second external voltage signal from the second input terminal (E2) to the second output terminal (A2) via the surge protection circuit device (G1, R1, Z1; G1, G2, R1, R2, Z1; G1, G2, R1, R2, Z1, Z2);

a second switching contact device (F2) for opening and closing the second current path (ST2);

a third electrical surge protection component (G2) which is connected between the fourth current path (ST3) and the first electrical surge protection component (G1);

wherein the conductor track connection device (B) bypasses a second interruption point (U2) in the fourth current path (ST4) in the non-tripped state;

wherein a ground terminal (M) is provided and a first node (KN1) between the first surge protection component (G1) and the third surge protection component (G2) is connected to the ground terminal (M); and wherein the mechanical actuating device (S, EF, SL) is set up for parallel opening of the first and second switching contact device (F1, F2) in the non-tripped state and for parallel closing of the closing of the first and second switching contact device (F1, F2) in the tripped state.

5. The surge protection apparatus as claimed in claim 4, wherein a fourth electrical surge protection component (Z2) is connected between the second output terminal (A2) and the second electrical surge protection component (Z1), wherein a second node (KN2) between the second and fourth surge protection components (Z1, Z2) is connected to the ground terminal (M);

wherein the conductor track connection device (B) bypasses a fourth interruption point (U2') in the fifth current path (ST5) between the fourth surge protection component (Z2) and the second output terminal (A2) in the non-tripped state.

6. The surge protection apparatus as claimed in claim 1, which further comprises:

a displaceable mechanical actuating device (S, EF, SL), wherein the mechanical actuating device (S, EF; SL) has a rotatable pivoting part (S) which is prestressed against the conductor track connection device (B) by means of a spring device (EF).

7. The surge protection apparatus as claimed in claim 6, wherein the mechanical actuating device (S, EF; SL) has a plunger (SL) which can be deflected by the pivoting part and which is connected to the first switching contact device (F1) or to the first and second switching contact devices (F1, F2) via a link part (KU).

8. The surge protection apparatus as claimed in claim 1, wherein the housing (BT, ST) is designed in two parts and has a base part (BT) and a plug-in part (ST), wherein the plug-in part (ST) is able to be plugged in in the base part (BT) in a latching and releasable manner, wherein the first and second current path (ST1, ST2), the first and second input terminal (E1, E2) and the first and second output terminal (A1, A2) and the first or the first and second switching contact device (F1, F2) are provided in the base part (BT) and wherein the surge protection circuit device (G1, R1, Z1; G1, G2, R1, R2, Z1; G1, G2, R1, R2, Z1, Z2), the printed circuit board (P) and a mechanical actuating device (S, EF; SL) are provided in the plug-in part (ST).

9. The surge protection apparatus as claimed in claim 8, wherein a plurality of plug-in contacts (P1, P2, P1', P2', PM) for electrically connecting the plug-in part (ST) to the base part (BT) are attached to the printed circuit board (P) and protrude out of the plug-in part (ST) and can be inserted into the base part (BT).

10. The surge protection apparatus as claimed in claim 8, wherein the mechanical actuating device (S, EF, SL) is designed in such a way that, when the plug-in part (ST) is not plugged into the base part (BT), the first or the first and second switching contact device (F1, F2) are closed.

11. The surge protection apparatus as claimed in claim 8, wherein the mechanical actuating device (S, EF; SL) has a plunger (SL) which can be deflected by the pivoting part and which can be inserted into the base part (BT) to open the first switching contact device (F1) or the first and second switching contact devices (F1, F2) in the non-tripped state.

12. The surge protection apparatus as claimed in claim 8, wherein the plug-in part (ST) and the base part (BT) each have a trough-like lower part (WST, WBT) which can be closed by means of a respective cover plate (DST, DBT).

13. The surge protection apparatus as claimed in claim 1, wherein an impedance device (R1, R2), preferably a resistor, is provided in the third and/or fourth current path (ST3, ST4).

14. The surge protection apparatus as claimed in claim 1, wherein the first and/or third electrical surge protection component (G1, G2) have a gas discharge tube.

15. The surge protection apparatus as claimed in claim 1, wherein a second electrical surge protection component (Z1) is connected in a fifth current path (ST5) between the first output terminal (A1) and the second output terminal (A2), wherein a fourth electrical surge protection component (Z2) is connected between the second output terminal (A2) and the second electrical surge protection component (Z1), and wherein the second and/or fourth electrical surge protection component (Z1, Z2) have a bidirectional Zener diode.

16. The surge protection apparatus as claimed in claim 1, wherein the first switching contact device (F1) or the first and second switching contact devices (F1, F2) are designed as elastic spring tongues.

17. The surge protection apparatus as claimed in claim 1, wherein the housing (GT) is designed in one piece and has a trough-like lower part (WGT) which can be closed by means of a cover plate (DGT).

* * * * *